US005139427A

United States Patent [19]

Boyd et al.

[11] Patent Number: 5,139,427

[45] Date of Patent: Aug. 18, 1992

[54] PLANAR ARRAY CONNECTOR AND FLEXIBLE CONTACT THEREFOR

[75] Inventors: David M. Boyd, Palmyra; Morgan J. Bradley; Douglas M. Walburn, both of Harrisburg, all of Pa.

[73] Assignee: AMP Incorporated, Harrisburg, Pa.

[21] Appl. No.: 763,851

[22] Filed: Sep. 23, 1991

[51] Int. Cl.[5] ..... H01R 9/09

[52] U.S. Cl. ..... 439/66; 439/81; 439/247; 439/591

[58] Field of Search ..... 439/66, 81, 82, 247, 439/591

[56] References Cited

U.S. PATENT DOCUMENTS 5,015,191 5/1991 Grabbe et al. ..... 439/66
5,069,627 12/1991 Buck et al. ..... 439/66

OTHER PUBLICATIONS

Schick, "Plated Through-Hole Contact", IBM Technical Disclosure Bulletin, vol. 6, No. 10, Mar. 1964, p. 5 & 6.

Design News, Apr. 8, 1991, p. 50, "Chip Socket".

Electronic Packaging & Production, Nov. 1990, p. 39, "Short Interconnects for Circuit Boards".

*Primary Examiner*—Paula A. Bradley
*Attorney, Agent, or Firm*—William B. Noll

[57] ABSTRACT

An electrical connector for interconnecting the contact pads (52, 56) of components (49, 53) features a planar lamination of insulating sheets forming a body (39) having recesses (46, 48) and apertures (44) containing contacts (10) formed of flat metal stock having spring characteristics including spring elements (22, 26, 30, 36) which provide a redundancy of contact interface through extending upwardly and downwardly relatively to said lamination to engage and interconnect the contact pads. Each of the spring elements is attached to a contact base with a free end providing a cantilever spring action, including wipe of contact points.

4 Claims, 6 Drawing Sheets

PLANAR ARRAY CONNECTOR AND FLEXIBLE CONTACT THEREFOR

This invention relates to a planar array electrical connector having multiple flexible contacts to interconnect the conductive pads of components including printed circuit boards.

BACKGROUND OF THE INVENTION

Integrated circuit components having hundreds of contact pads located on close centers as for example, on 0.050 inch centers have evolved to accommodate complex functions for use with computers, communication equipment, and the like. These components are typically interconnected to define a given function through a rigid or flexible printed circuit board having pads on centers complementary to those of the components and arranged in a planar disposition. A variety of means are employed to effect the interconnection of component pads to circuit pads, including packages like those shown in U.S. patent application No. 07/686,100, filed Apr. 4, 1991, which features a variety of contacts held in a plastic lamination on centers complementary to pads of components and circuits. The Application teaches contacts which range from those requiring an extremely low closure force, such as those made of a conductive gel, to those requiring an intermediate force which are formed of fine conductive wire termed "fuzz" buttons, and, for the more rigorous applications, a type of coil spring called or known as a "canted" coil spring. Housings for the different uses clamp the contacts against pads and are, accordingly, of different constructions, dependent upon the duty of the connectors in terms of environment, vibration, and stress and the like.

The publication *Design News*, at page 5, Apr. 4, 1991 shows a further example of the type of connector and packaging employed to accommodate interconnection of integrated circuits and printed circuit boards and the like having large numbers of closely centered contact pads.

The present invention has as an object an improvement on the connector of the foregoing application in respect to the configuration of the contacts thereof, to provide both a redundancy of contact points per pad location, and to provide a wipe of the contact points and interconnected pads. The invention has as a further object the provision of a readily manufacturable array of contacts which have a consistency of dimension and force characteristics due to having been formed from a conductive sheet material having known spring characteristics through stamping or etching and forming. Still a further object is to provide a high density lamina and planar connector construction which is readily manufactured to provide closely centered contacts.

SUMMARY OF THE INVENTION

The present invention achieves the foregoing objects through the use of a multiplicity of contacts held in a body of plastic, preferably formed of a lamination of plastic sheet material, including interiorly directed recesses which captivate, hold and position the contacts relative to apertures in the insulating body and sheets forming the lamination; in conjunction with contacts in a number of embodiments which each include curved contact finger elements made to have a multiplicity of contact points per contact. The contacts include finger elements formed out of flat metal stock which define spring members fastened to a base of the sheet material and free at the opposite end to define cantilever spring action with the spring elements oppositely oriented in an upward and downward sense to engage the pads of components such as integrated circuits and components such as flexible or rigid printed circuit boards and electrically interconnect such pads. The invention connector is placed between the planar surfaces of such components, which components are then driven and held axially against the connector to deform the contacts thereof and effect such interconnection. Each of the contacts, by virtue of its geometry, operates to provide a wipe of the contact points of the contact as well as a wipe of the pads being interconnected. In one embodiment, the contact base is formed as by folding portions of conductive sheet material together with curved finger elements extending upwardly and downwardly from the base so formed and oriented oppositely so as to wipe in opposite direction providing a redundancy of contact points for each of the pads being interconnected. In another embodiment, the finger elements are struck from a planar base and curled around such base inwardly with the contacts of one side alternating in an upward and downward sense. Upon compression of the contacts, the contact points thereon are driven axially transverse to the planar disposition of the connector and of the components and displaced slightly or parallel to such disposition to provide a wiping of the contact points and of the pads.

IN THE DRAWINGS

DETAILED DESCRIPTION OF THE INVENTION

Figure 5:
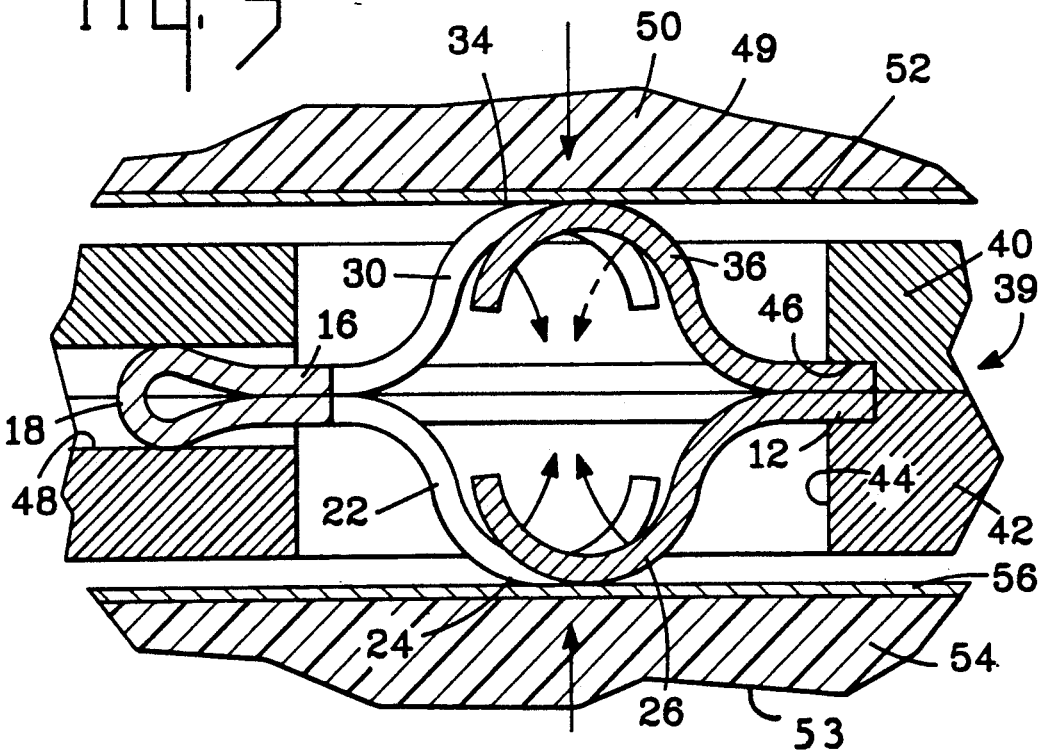
FIG. 5 is a view of the contact of FIG. 4 compressed by components and the pads thereof to effect an interconnection.
Figure 6:
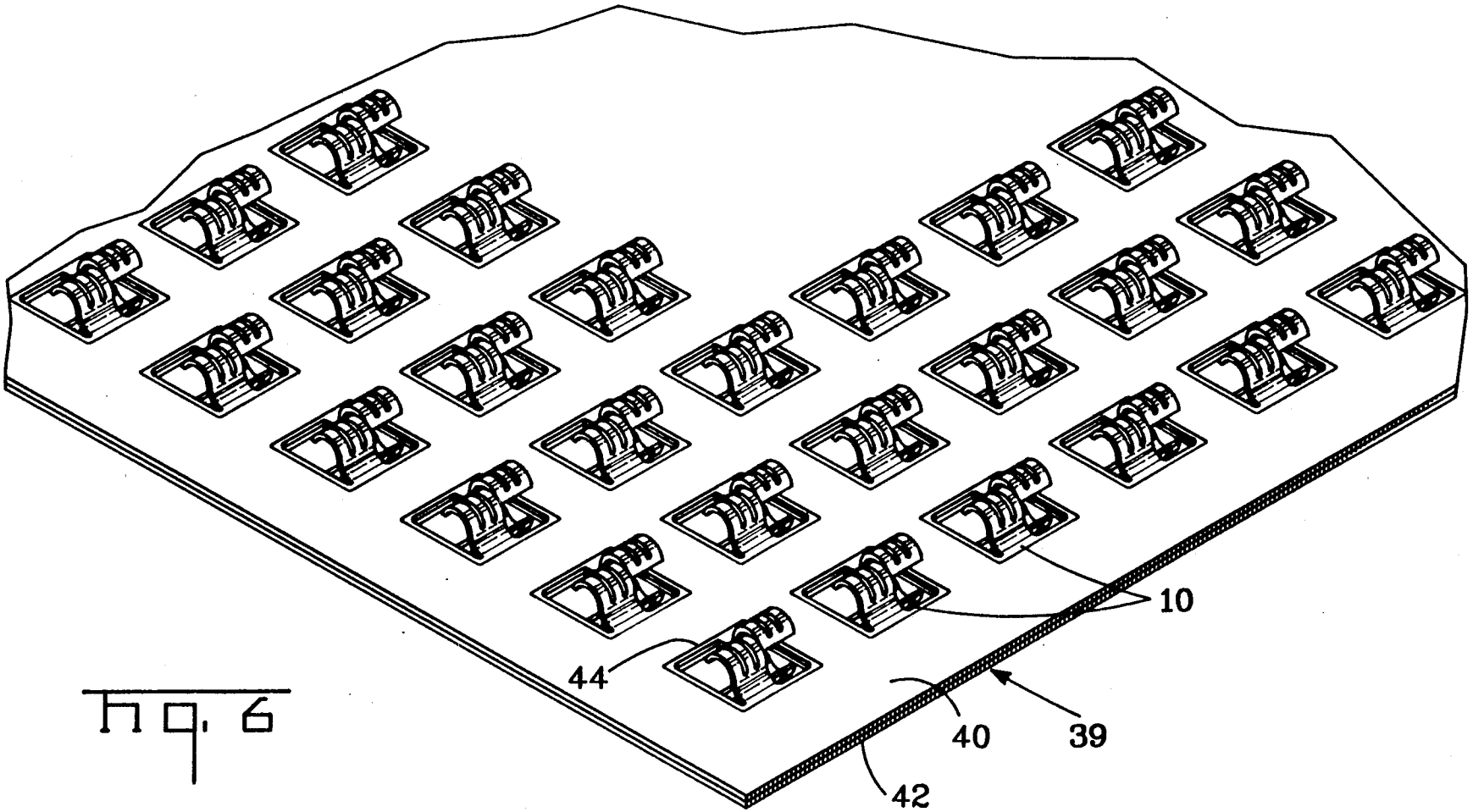
FIG. 6 is a perspective showing a corner of the connector of the invention and arrays of contacts mounted in the insulating body.
Figure 7:
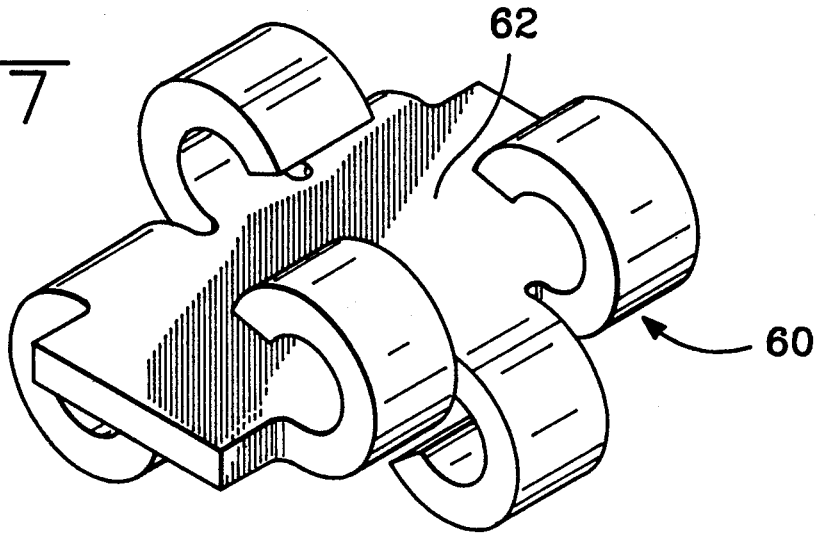
FIG. 7 is a perspective, substantially enlarged, of an alternative embodiment of the invention.
Figure 8:
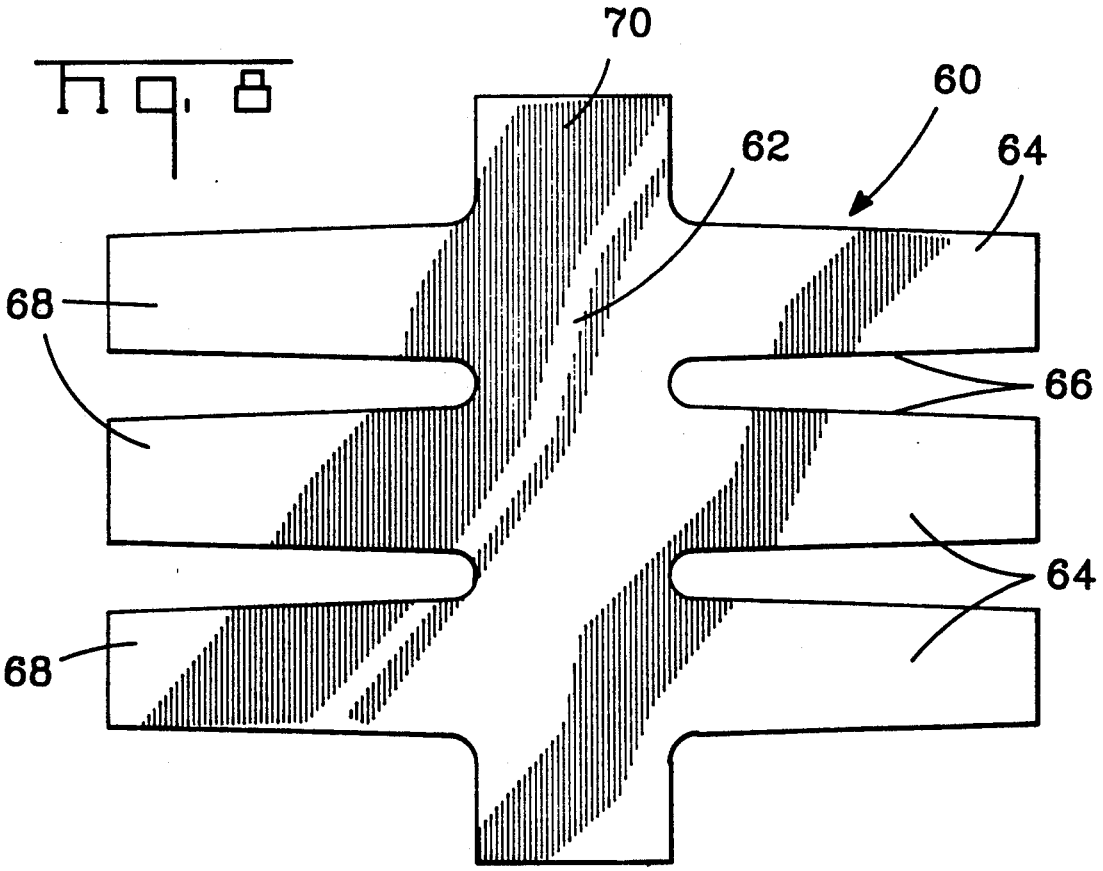
FIG. 8 is a plan view of the profile of the contact of FIG. 7 prior to forming.
Figure 9:
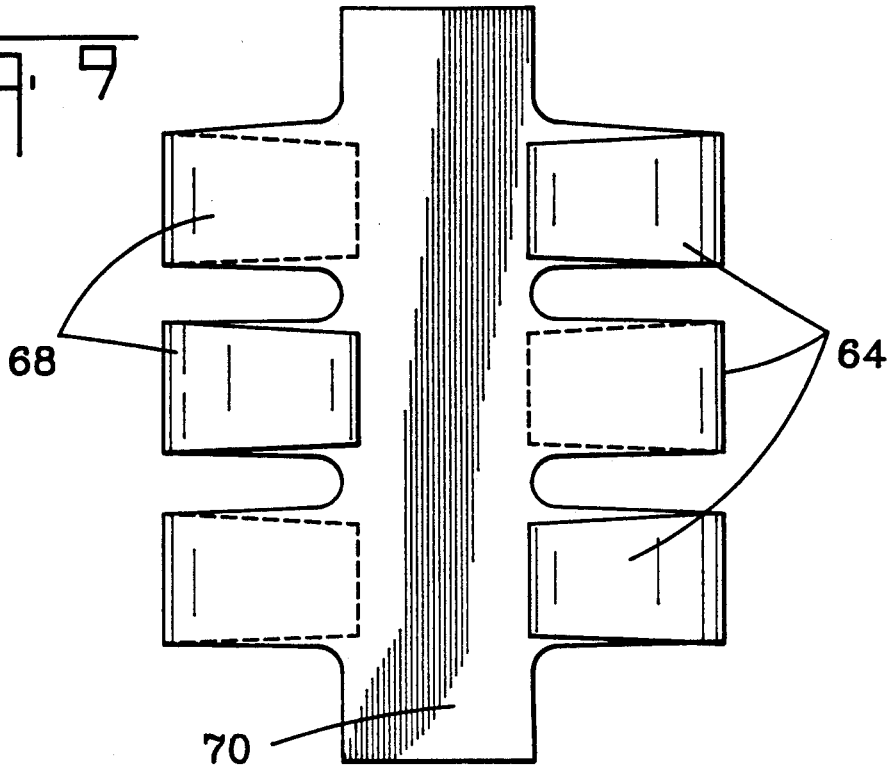
FIG. 9 is a plan view of the contact of FIG. 7 following forming.
Figure 10:
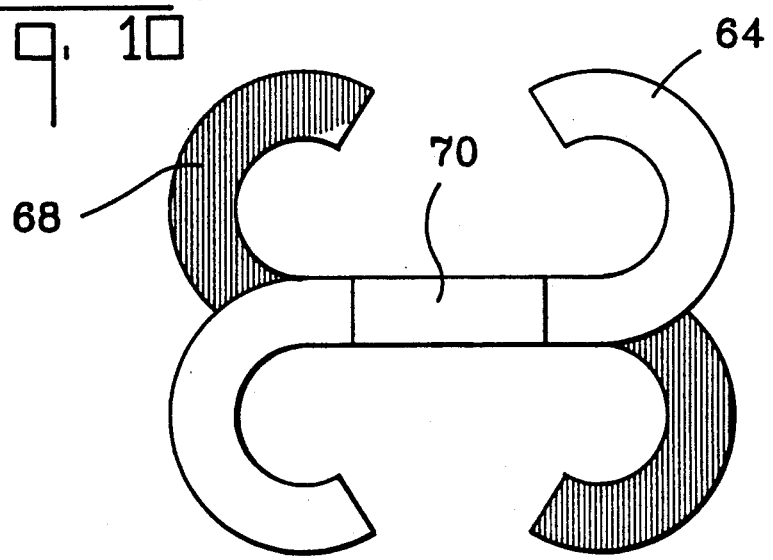
FIG. 10 is a side elevational view of the contact of FIGS. 7-9.

Referring first to FIG. 6, an assembly is shown, including contacts 10 in a planar array held and mounted in a plastic body 39. As can be seen in FIG. 5, the contacts project above and below the body 39 which is formed of an insulating and plastic sheets 40 and 42. Sections of components 49 and 53 are shown in FIG. 5 bearing against a contact 10 which serves to interconnect the conductive pad 52 of component 49 to the conductive pad 56 of component 53; the pads carried on insulating bodies 50 and 54, respectively, body 54 typically representing a printed circuit board. The conductive pads 52 and 56 typically are interconnected to traces internal to the component and to a printed circuit board or the like which lead to other components and which together form a functioning circuit. Reference may be had to the aforementioned U.S. patent application No. 07/686,100, which discloses different packages which carry laminar, planar connector arrays similar in general function to that shown in FIG. 6 of this Application. The mentioned Application is incorporated by reference into this Application for the purposes of disclosure of housings for the type of planar array here contemplated.

As will be discerned from FIG. 5, closure of the components 49 and 53 drive the contact 10 axially inwardly along the lines thereshown in a sense transverse to the plane of the components and the pads thereof. In practice, the closure in a relative sense of the components and conductive pads is controlled to give a normal force, generated by contact 10 through contact points on the contact that are sufficient to provide a stable, low-resistance electrical path through the contact and between the pads. As can also be discerned in FIGS. 4 and 5, compression of the contacts 10 causes the free ends of the contact fingers to, in essence, rotate, effecting a wipe between the contact points of contacts 10 and the surfaces of the pads 52 and 56. As can be appreciated, the relative displacement of contact points and pad surfaces is slight, but sufficient to clear debris and oxides from the contact points and the pad surfaces to enhance the characteristics of the interconnection. This feature of the invention is also present in the embodiments shown in FIGS. 7–10; namely, inward displacement of the contact spring elements along an axis transverse to the plane of the component pad surfaces also causes a slight displacement of the contact points parallel to such plane to effect the aforementioned wipe.

Figure 1:
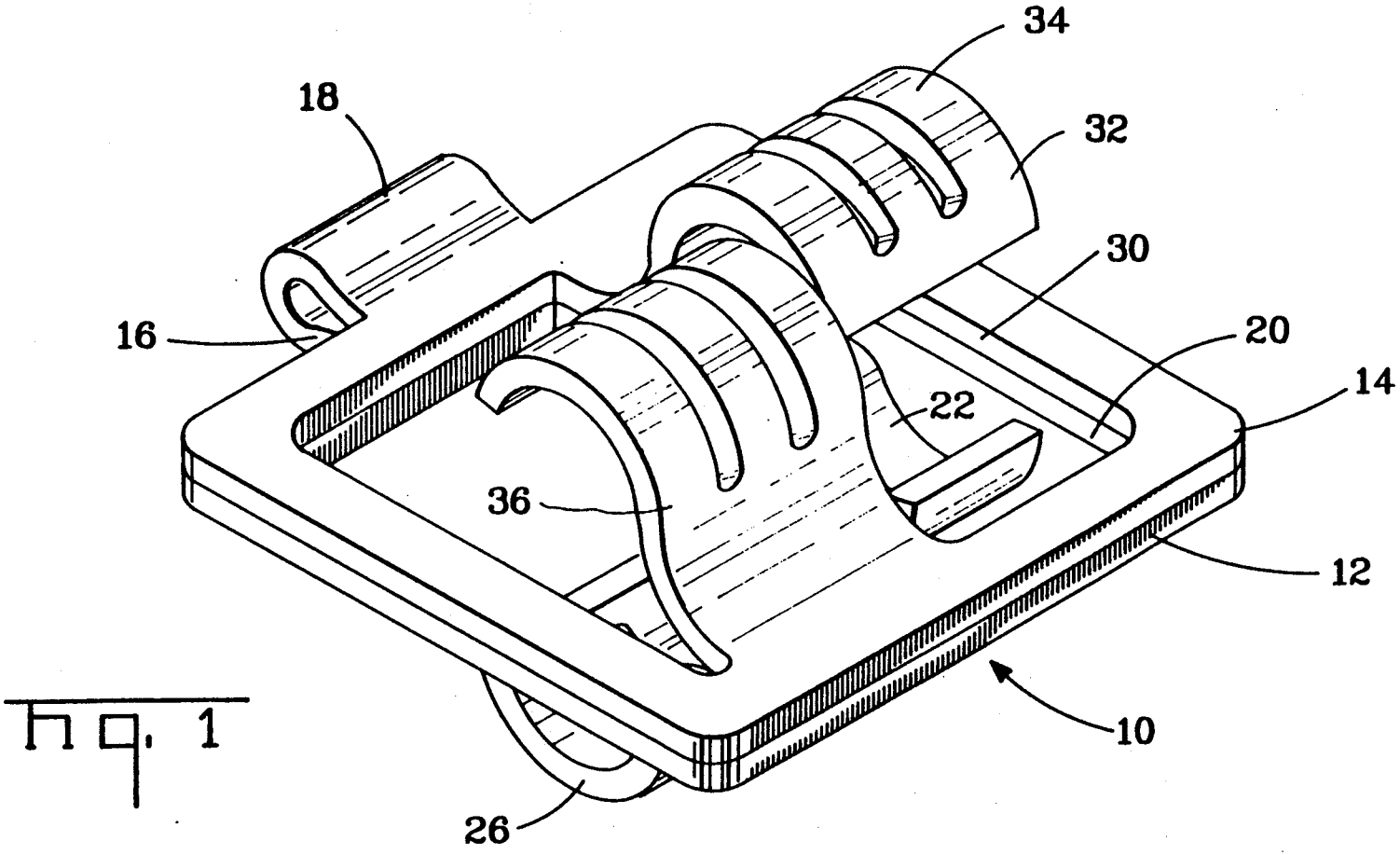
FIG. 1 is a perspective, substantially enlarged, of one embodiment of the contact of the connector of the invention.
Figure 2:
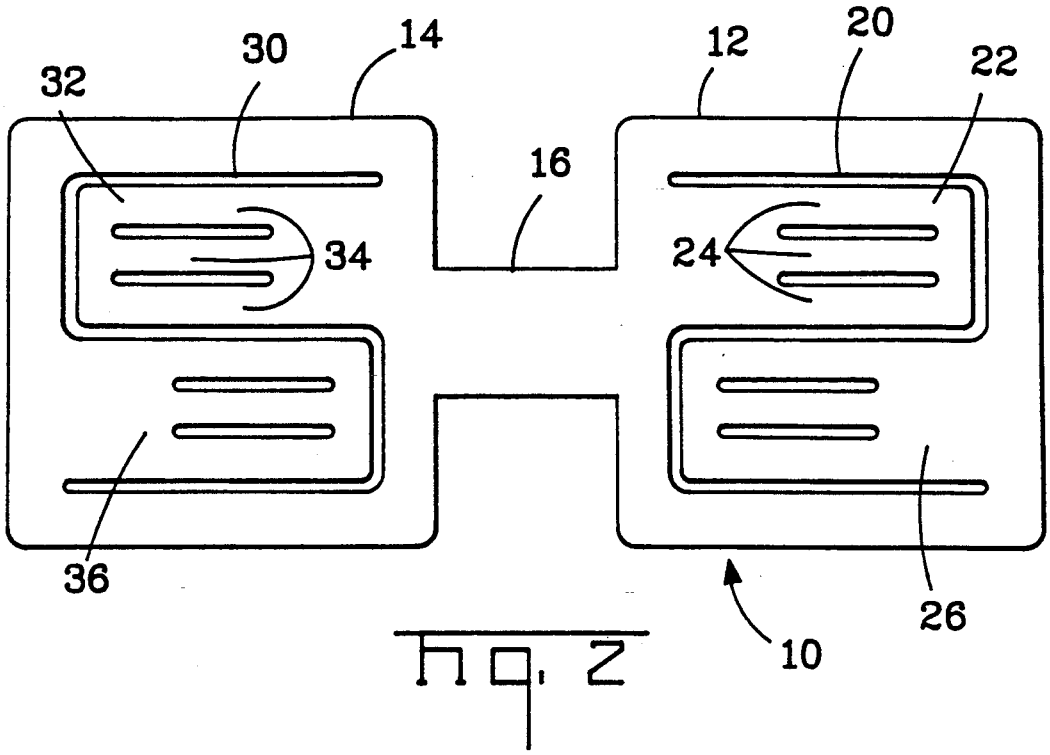
FIG. 2 is a view of the contact shown in FIG. 1 prior to folding thereof and forming of the contact fingers thereof.
Figure 3:
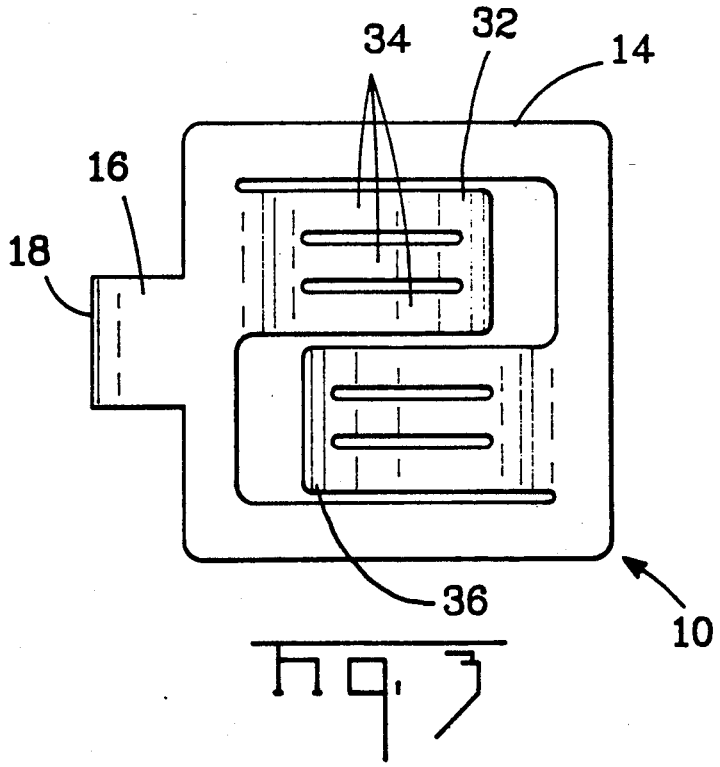
FIG. 3 is a plan view of the contact shown in FIG. 1 and in FIG. 2 following folding.
Figure 4:
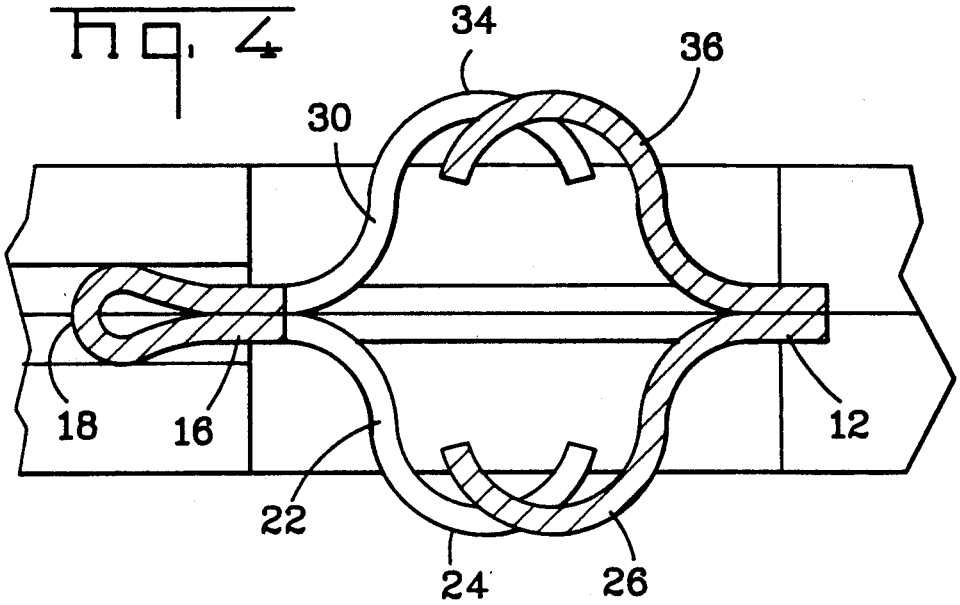
FIG. 4 is a side and partially sectioned view of the contact of FIG. 1 mounted in a laminar insulating body.

Back now to FIG. 1, the contact 10 thereshown includes a base comprised of frame elements 12 and 14 which are folded together through an integral portion 16 of sheet material, note FIGS. 2 and 3 and fold 18. As shown in FIG. 2, the contact 10 has an original flat shape which is stamped and formed to include a series of S-shaped separations 20 and 30 in the halves 12 and 14 which define sets of finger elements 22, 26, 32, and 36. To be noted, the finger elements are oriented oppositely with respect to being joined at the base of the respective portions 12 and 14 and further include separate portions 24, three in number, for each finger element, with respect to portion 12, and portions 34, three in number, with respect to portion 14. The contact body portion 12 thus includes some six contact points as does the body portion 14. As can be seen from FIGS. 2 and 3, and particularly with respect to FIG. 1, the finger elements 22, 26, 32, and 36 are formed into a curved configuration as by die stamping and the body portions 12 and 14 are formed by the folding of material 16 as at 18. FIG. 4 shows the disposition of the curved finger elements relative to being mounted in the body 39, trapped in the laminates 40 and 42. These laminates are recessed as at 46 and as 48 to receive the opposite ends of the contact 10 and entrap, position and hold such contacts relative to the apertures 44 formed in the portions 40 and 42. The laminates 40 and 42 may be joined together as by an adhesive applied to the interior planar surfaces thereof, or by heat staking through ultrasonic energy or other forms of selectively applied heating of the plastic material thereof. The connector body 39, in the configuration shown by a corner of such connector in FIG. 6, can thus be applied by being disposed between components such as an integrated circuit and a printed circuit board to interconnect the pads thereof which are on centers complementary to the contacts 10. To be appreciated is the fact that the connector body 39 can be placed in a number of different sorts of housings and packages to provide a suitable alignment of contacts 10 with the pads of components and boards.

In accordance with the invention, the contacts 10 may be formed of a thin conductive material, including stainless steel, beryllium copper, phosphor bronze, and various alloys thereof. It is contemplated that the springs may be selectively plated to include a variety of finishes on the contact points of the curved spring elements, at the maximum height dimension of such members, those which will come in contact with the component and board pads. Finishes such as gold over nickel or other finishes typical of providing a low-resistance, stable interface are contemplated.

In a functioning design, the contact material was on the order of between 0.0015 inches in thickness up to 0.003 inches in thickness utilized with a plastic body wherein both portions 40 and 42 have a total thickness of on the order of 0.0085 inches up to 0.0170 inches and are formed of insulating dielectric material such as a polyamid or polyester. The apertures 44 formed in the bodies were on the order of 0.030 inches in width and 0.030 inches in length, referring to the apertures 44 shown in FIG. 6. The contacts 10 included an uncompressed height dimension on the order of 0.0230 to 0.0250 inches. This provided roughly 0.0040 to 0.0080 inches of protrusion of each contact side upwardly and downwardly relative to the body 40. This in turn provided a sufficient deflection potential of the contacts under compression by the pads of the components of printed circuit boards to develop an appropriate normal force resulting in a stable, low-resistance interface. The invention contemplates that the contacts 10 may be fabricated as by stamping and forming or as by etching and forming, with the curved surfaces effected through die stamping of etched planar material.

Referring now to FIGS. 7–10, an alternative contact 60 is shown which includes a base 62 and a plurality of finger elements 64 and 68 spaced apart by material removed as at 66 to define on each side of the base 62 finger elements. In accordance with the invention, the finger elements 64 and 68 are alternatively formed upwardly or downwardly in a manner shown in FIG. 7 to provide a three-point contact system, three contact points on each side arranged in a triangular pattern, to provide a stability of interface and redundancy of contacts with the pads of components and printed circuit board. The contacts of 60 would be mounted in a lamination or in an insulating body similar to the body of 39 with the ends 70 of the contacts 60 entrapped in interior recesses between laminations of the body such as 40 and 42 in the manner shown with respect to FIGS. 4 and 5. To be noted from FIG. 10, the curved finger elements would operate to be compressed along an axis perpendicular to the plane of the pads of component and board and would also move parallel to the plane of such pads to effect a slight wipe of the contact interfaces. The general dimensions of the contacts shown in FIGS. 7–10 would be similar to that mentioned relative to the embodiments of FIGS. 1–6.

While the preferred embodiments are as shown in the various figures, it is to be understood that variations in orientation of the spring elements defining the contact may be made. For example, the slots 20 and 30 oriented as shown in FIG. 2 may be rotated 90° in elements 12 and 14 to provide differently oriented spring action. Or, the ends of the elements shown closed in the embodiments of FIG. 2 may be left open as in the embodiment of FIG. 8. Greater or fewer finger elements than three per side are contemplated by the invention and the use of a non-folded contact such as half 12 of the contact 10 may be employed. Additionally, in applications requiring axial displacement of the finger elements to a degree causing the curved free ends to engage the opposite side contact pad, the ends of the finger elements may be oppositely curved away from the direction of displacement to preclude such engagement. This can be important with sheet material thinner than that described where the component contacts constitute buttons rather than pads.

We claim:

1. An electrical connector for interconnecting arrays of contact pads on components which are in a planar matrix on a given spacing, including an insulating body of planar configuration having apertures extending therethrough defining a planar matrix on said given spacing, a contact in each aperture and means holding said contacts therein, each contact having been formed of a thin, flat, conductive material to include a plurality of rounded finger elements extending upwardly and downwardly from said body out of said aperture and with said contact elements including a series of slots with the slots defining independent contact points, and an integral portion of each finger element joining the said contact points together with said elements defining spring members adapted to be compressed by the contact pads of the said components upon said components being driven relatively together against the spring members to provide said interconnection of contact pads.

2. An electrical connector for interconnecting arrays of contact pads on components which are in a planar matrix on a given spacing, including an insulating body of planar configuration having apertures extending therethrough defining a planar matrix on said given spacing, a contact in each aperture and means holding said contacts therein, said contact having been formed of a thin, flat, conductive material to include a plurality of rounded finger elements extending upwardly and downwardly from said body out of said aperture and with each contact being comprised of a planar portion forming a frame with the said finger elements formed within the said frame with said elements defining spring members adapted to be compressed by the contact pads of the said components upon said components being driven relatively together against the spring members to provide said interconnection of contact pads.

3. An electrical connector for interconnecting arrays of contact pads on components which are in a planar matrix on a given spacing, including an insulating body of planar configuration having apertures extending therethrough defining a planar matrix on said given spacing, a contact in each aperture and means for holding said contacts therein, each contact having been formed of a thin, flat, conductive material to include a plurality of rounded finger elements extending upwardly and downwardly from said body out of said aperture and with each contact being comprised of a planar portion forming a frame with the said finger elements formed within the said frame and the said body including interior recesses engaging said frame to provide said means for holding said contacts in said aperture with said elements defining spring members adapted to be compressed by the contact pads of these said components upon said components being driven relatively together against the spring members to provide said interconnection of contact pads.

4. An electrical connector for interconnecting arrays of contact pads on components which are in a planar matrix on a given spacing, including an insulating body of planar configuration having apertures extending therethrough defining a planar matrix on said given spacing, a contact in each aperture and means holding said contacts therein, each contact having been formed of a thin, flat, conductive material to include a plurality of rounded finger elements extending upwardly and downwardly from said body out of said aperture with the said contacts including a frame with the said spring elements extending in cantilevered fashion inwardly of said frame and with said elements defined by spring members adapted to be compressed by the contact pads of the said components upon said components being driven relatively together against the spring members to provide said interconnection of contact pads.

* * * * *